United States Patent [19]

Hicks

[11] 4,224,718

[45] Sep. 30, 1980

[54] PNEUMATIC CLEANING OF THE CHAMBER CARDING ELEMENTS OF A TEXTILE MACHINE

[75] Inventor: Harry H. Hicks, Winston-Salem, N.C.

[73] Assignee: Industrial Air, Inc., Greensboro, N.C.

[21] Appl. No.: 961,936

[22] Filed: Nov. 20, 1978

[51] Int. Cl.[2] ..... D01G 15/82

[52] U.S. Cl. ..... 19/107; 15/301

[58] Field of Search ..... 19/107, 105; 15/301, 15/345

[56] References Cited

U.S. PATENT DOCUMENTS

| | | | |
|---|---|---|---|
| 2,964,804 | 12/1960 | Schonenberger | 19/107 |
| 3,987,517 | 10/1976 | Bonalumi | 19/107 |

FOREIGN PATENT DOCUMENTS

| | | | |
|---|---|---|---|
| 562740 | 7/1944 | United Kingdom | 19/107 |
| 1019768 | 2/1966 | United Kingdom | 19/107 |
| 355258 | 11/1972 | U.S.S.R. | 19/107 |

*Primary Examiner*—Louis Rimrodt

[57] ABSTRACT

An air current is caused to sweep through the chamber beneath a carding machine from one end to the other by means of a suction plenum beneath the lickerin end of the machine and an air inlet beneath the doffer end of the machine through which air enters and is conveyed toward the suction plenum. One or more baffles extending across the width of the area beneath the carding elements extend down in close proximity to the floor causing the air to pass closely adjacent the floor, rather than to drift up into the upper areas of the chamber. One of the aforementioned baffles is adjustably positioned in air deflecting arrangement with the aforementioned inlet to divert the incoming air currents immediately to the floor. The suction plenum is so connected with a source of negative pressure as to cause an air flow rate of at least 360 cfm through the inlet to the suction plenum. This combination causes such air currents to be guided downwardly beneath the lower edge of the inlet baffle and along the floor toward the suction plenum thereby creating a floor sweeping effect.

4 Claims, 2 Drawing Figures

PNEUMATIC CLEANING OF THE CHAMBER CARDING ELEMENTS OF A TEXTILE MACHINE

BACKGROUND OF THE DISCLOSURE

During operation textile carding machines generate considerable amounts of dust, fibers, and lint which are emitted at various points on the card as the stock proceeds through the machine. Various lickerin and doffer plenums are known in the prior art which are mounted on the upper portions of the machine and connected to suction ducts leading to filtration systems, and are generally adequate to capture most of the dust and fibers emitted upwardly from the upper portions of the card machine.

However, cleaning of the under card chamber or cavity has been a more difficult task to perform due to the size thereof and the turbulence therein generated by the rotation of the elements thereabove. Efforts have been made to eliminate dust and lint in such an area which began with manual, periodic shoveling or scraping of the lint from beneath the machine by workers. Subsequently plenums with suction ducts attached thereto have been installed under the carding elements to capture lint, dust and fly that falls through. Examples of such prior art devices include the British patent to David Walsh British Pat. No. 562,740 in which an under card cleaning system is provided with a collection tube or suction opening at one end and a fan at the other end of the area beneath the carding machine which blows air currents toward the suction tube. A plurality of curved baffles extend from an upper point and curve downwardly toward the suction inlet which are both intended to prevent an upward flow of the air to the rotating parts while enabling air passing along the baffles to convey fly deposited thereon toward the suction opening.

Also, U.S. Pat. No. 2,964,804 to Schonenberger and U.S. Pat. No. 4,057,887 to Gunter are both illustrative of suction plenums which are designed to maintain the underneath area of the carding machine clean from lint, dust and fly.

SUMMARY OF THE PRESENT INVENTION

The apparatus according to this invention, however, is directed to the concept of generating a gentle sweeping air flow path across the floor beneath the under card chamber and controlling its path of flow in such a manner as to sweep closely adjacent the floor removing all dust, lint, fly and the like. Such a device induces air across the floor of the undercard chamber by suction only rather than by blowing, or a combination of negative and positive air pressure which may tend to cause turbulent areas thereunder. Also, the device according to the present invention is very simple because the parts are easily removable for cleaning and maintenance, leading to a low maintenance cost.

In its broadest sense, the carding machine pneumatic waste removal system according to the present invention includes suction plenum positioned adjacent and beneath the lickerin end of the card frame and having an inlet extending across the width of the frame providing communication between the interior of the plenum and the space enclosed by the side walls around the frame beneath the carding machine. A source of negative pressure is connected to the suction plenum to induce an air flow rate of 360 cfm into the air plenum. This creates gentle air currents commencing at the opposite end of the machine which flow from space beneath the machine. An inlet at the opposite end of the frame from the suction plenum provides an entrance for air to be drawn by the suction plenum and conveyed across the floor of the under card spaced toward the suction plenum. One or more substantially vertical baffles are removably and adjustably attached to the frame of the carding machine and extend substantially across the width of the space therebeneath. In a preferred embodiment one of the baffles is adjustably positioned in air deflecting arrangement with the air inlet to direct incoming air currents immediately to the floor. In a second embodiment, another of the baffles may, if desired, be positioned closely adjacent a main cylinder at a point slightly rearwardly from the nip between the doffer and main cylinder toward a suction plenum therefrom. A lower edge of the aforementioned main cylinder/doffer baffle is spaced from the floor a distance in the range of two to four inches and the lower portion of the baffle is bent to slant downwardly and rearwardly, causing the air currents emitted beneath the inner section of the doffer and main cylinder to be guided down into the sweeping motion of the lower air path without causing a resulting turbulence therein. In further alternate embodiments, additional baffles may be added beneath the center line of the main cylinder and beneath the intersection of the main cylinder and lickerin.

It is therefore an object of the present invention to provide an improved system for keeping the under chamber of a carding machine clean by applying a continuously moving air current across and adjacent the floor thereof.

It is another object of the present invention to provide a system of the type which includes one or more baffle elements for directing the path of the make-up air introduced beneath the carding elements.

It is yet another object of the present invention to provide a system of the type described which eliminates the use of compressed air, as well as providing a low maintenance cost to the clean up of the area underneath the carding elements.

Other objects and a fuller understanding of the invention will become apparent from the following detailed description of a preferred embodiment when read in conjunction with the associated drawings in which:

FIG. 1 is a sectional schematic representation taken substantially along the longitudinal axis of a carding machine and illustrating the waste removal system according to the present invention; and FIG. 2 is a perspective view of the frame portion of the carding machine looking down from the top with the carding elements removed.

DETAILED DESCRIPTION OF A PREFERRED EMBODIMENT

Figure 1:
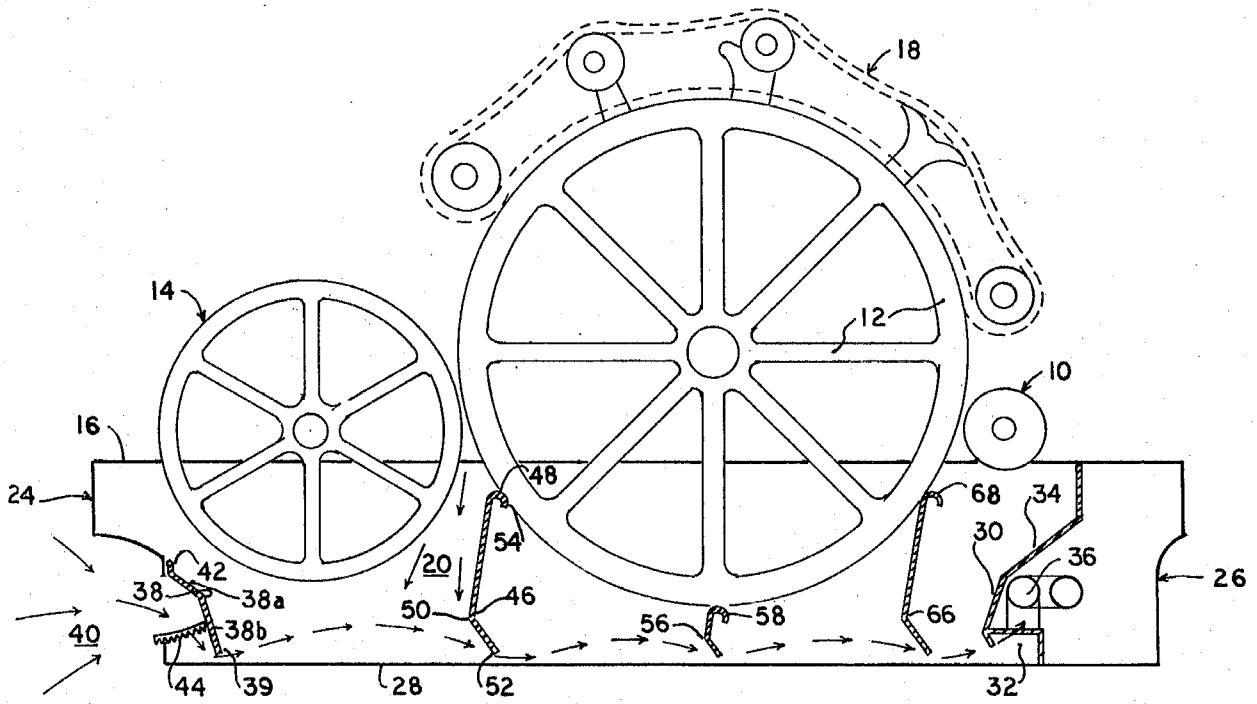
Figure 2:
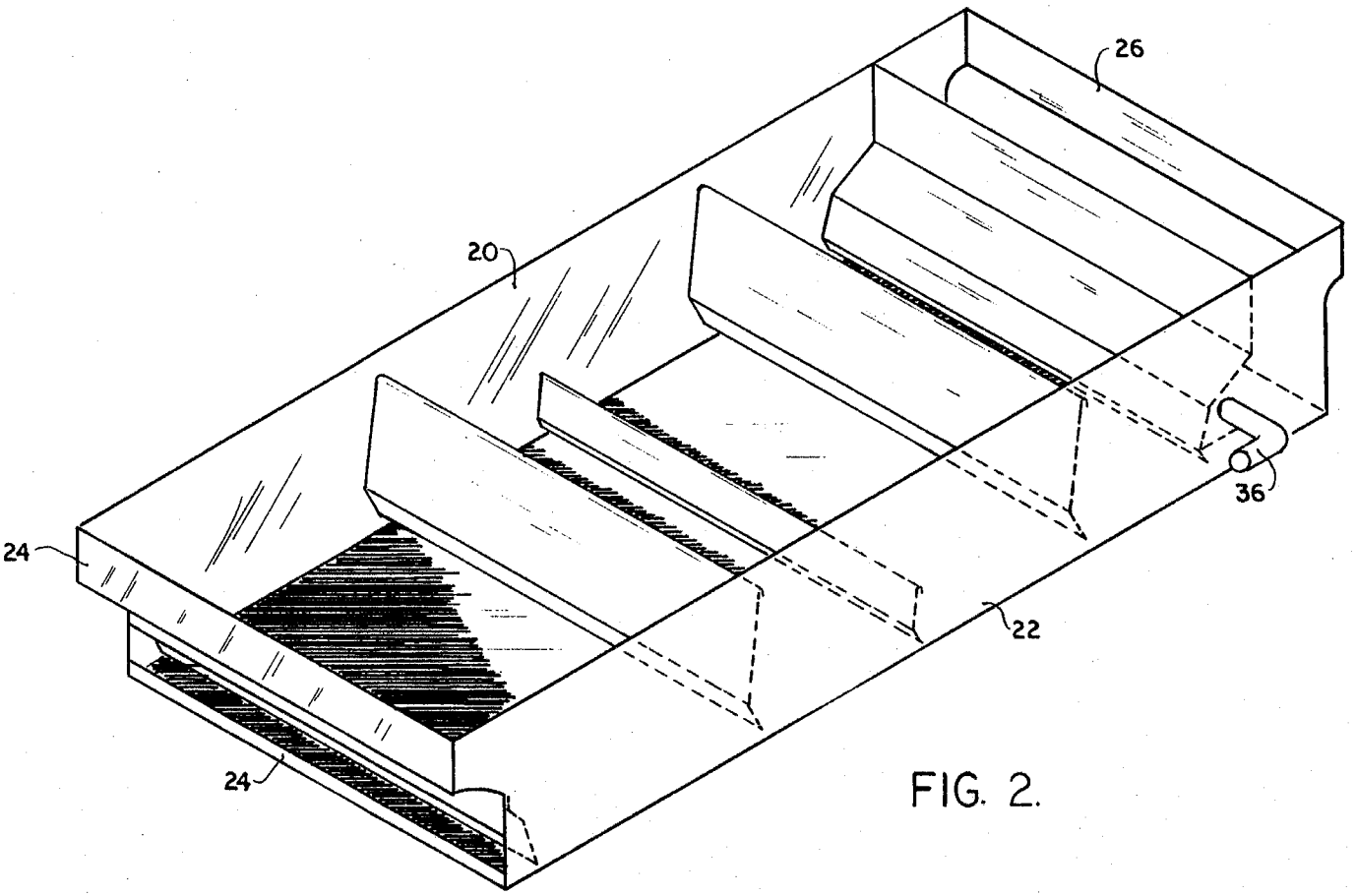

Turning now to FIG. 1 there is illustrated schematically a carding machine of the type in which a lickerin 10, a main cylinder 12, and a doffer 14 are mounted on a frame 16. A set of working flats 18 is mounted above the main cylinder 12 and raw cotton is passed through the carding machine to form silver in a conventional known manner. The carding process, being well known, will not be discussed further herein other than to mention that during the forming of the sliver by the carding elements 10,12,14 and 18, considerable lint, dust , and fly all of which will hereinafter be collectively referred to as waste, is generated and works its way into the chamber formed by frame 16 beneath the carding elements 10, 12, and 14, as well as into the atmosphere above the carding machine. Other types of waste collection equipment are known for collecting waste from the area above the carding elements and this invention is directed to the collection of such waste that drops down into the chamber formed by the frame 16 and its covering walls.

The remainder of the specification will be directed to a discussion of the frame 16 and the waste collection system which is constructed therein beneath the carding elements 10, 12, and 14. First of all, the frame 16 includes a pair of side walls 20,22 extending along opposite sides of the frame 16 and a pair of end walls 24,26 across the ends thereof. End wall 24 extends across the end of the frame 16 adjacent the doffer end while end wall 26 extends across the end of the frame nearest the lickerin 10. The purpose of the frame 16 is to elevate and support the carding elements 10, 12 and 14 above the level of the floor 28. The walls 20, 22, 24, 26 merely enclose the chamber beneath the carding elements and confine the waste therein as much as possible.

At the lickerin end of the frame 16 there is provided and mounted a suction intake plenum 30 which includes an intake orifice 32 extending across the width of the frame 16 adjacent the floor thereof. The upper wall 34 of plenum 30 extends between the upper edge of frame 16 to the orifice 32 and generally serves to seal off the rear end of the frame 26, forming one end of the chamber which exists between the carding elements 10,12 and 14 and the floor 28. A conduit 36 extends out one side of the plenum 30 is connected to a source of suction for negative pressure (not shown). The negative pressure which is applied through conduit 36 to the intake orifice 32 is of such magnitude as to create a flow rate into the orifice 32 of 400 cfm of air. This flow rate has been observed to be perfectly adequate to keep the floor beneath the machine clean in the present system which is utilized with conventional carding equipment running at speeds generally known in the industry today. However, a flow rate into the intake orifice of less than 360 cfm has been observed to be inadequate to maintain a clean floor or chamber.

At the opposite end of the frame there is an adjustable intake baffle or door 38 provided which is set to maintain a slight gap between the lower edge 39 and the floor 28. The intake baffle 38 includes an upper wall 38*a* slightly slanted downwardly and inwardly, then a rear wall 38*b* which is more vertically oriented to overlie the inlet 40 through the end wall 24. So shaped the baffle 38 maintains a flow path of fairly consistent cross-section, so as not to speed up or slow down the entering air. Further the baffle prevents undue influence on the web on the doffer by the incoming air. The adjustable door or baffle 38 is preferably hingedly attached at the top by means of a conventional hinge means 42, and an adjusting element such as a slotted bar 44 is connected to the outer side of door 38 so that the door may be adjustably set in various positions of opening.

A plurality of secondary baffles 46, 56, and 66 may be provided, if desired, to extend across the width of the frame between the side walls 20,22. Such secondary baffles are strategically positioned at various points along the length of the frame 16. A first baffle 46 has its upper edge 48 positioned closely adjacent the main cylinder roll 12 at a point slightly rearwardly toward the lickerin end of the frame from the nip between the main cylinder 12 and doffer 14. Baffle 46 then extends downwardly from the aforementioned point to a break point 50, whereupon the baffle extends rearwardly and downwardly to a lower edge 52 spaced slightly above the floor 28. A releasable hook or support means 54 releasably connects the baffle 46 to the side walls 20 and 22 of the frame. So positioned and arranged, the baffle 46 causes the air currents entering through the opening 40 and beneath the lower edge of the inlet baffle 38 to remain or follow a path along the floor 28 in a sweeping motion toward the inlet 32 of plenum 30.

A second baffle 56 is releasably supported by a hook means 58 similar to the manner in which the baffle 46 is suspended by hook means 54. The second baffle 56 extends downwardly from a point approximately adjacent to the center line of the main cylinder 12 and downwardly to a point slightly spaced above floor 28.

A third baffle 66 is similarly suspended by a hook means 68 at a point closely adjacent the main cylinder 12 at a point just forwardly of the nip between the main cylinder 12 and lickerin 10 and extends downwardly therefrom, at first forwardly, then rearwardly to a point slightly spaced above the floor 28. All of the baffles mentioned hereinabove cause the air currents entering access door 40 to follow a sweeping motion along the floor 28. The first mentioned inlet baffle 38 is probably the most important and by experimentation it has been found that the other three may, if desired, be omitted without substantial loss of cleaning effect.

While a preferred embodiment of the present invention has been shown and described hereinabove, it is apparent that some modifications and alterations might be made to the invention without departing from the scope thereof, which is set forth in the following claims.

What is claimed is:

1. In a textile carding machine of the type having such carding elements as a lickerin, main cylinder and doffer operatively mounted on a frame and walls covering the sides and ends of the frame between the top of said frame and the floor, an improved pneumatic waste removal apparatus for removing trash and waste which tends to accumulate beneath the carding machine, said apparatus comprising:

(a) a suction plenum positioned adjacent and beneath the lickerin end of said frame and having an intake orifice extending across the width of said frame providing communication between the interior of said plenum and the space enclosed by said side walls;

(b) a source of negative pressure connected to said suction plenum to induce air currents into said plenum from said space, said source of negative pressure being of such magnitude as to exert an air flow rate of at least 360 cfm through the intake orifice of said suction plenum;

(c) an inlet means through the wall covering the end of said frame opposite said suction plenum through which air is drawn by said suction plenum and conveyed across the floor of said space toward said suction plenum;

(d) a first baffle attached along the upper edge thereof to the end wall which contains said inlet and extending substantially across the width of said frame in confronting relation to said inlet, said baffle including an upper wall slanting slightly downwardly but mostly inwardly and a rear wall slanting slightly inwardly but mostly downwardly, and having a lower edge spaced from said floor a distance between two and four inches;

(e) whereby air entering from the outside through said inlet means is deflected downwardly toward said floor and caused to continuously sweep across the floor carrying lint and waste to said suction plenum where they are collected.

2. The apparatus according to claim 1 wherein said first baffle is attached to said frame in vertically adjustable relation thereto whereby the space between said lower edge and said floor may be varied.

3. The apparatus according to claim 1 wherein additional baffles are positioned at spaced points along the length of the chamber beneath the carding elements and extend transversely across the width thereof, said additional baffles having a lower edge spaced above the floor a distance of two to four inches.

4. The apparatus according to claim 3 wherein one of said additional baffles is attached to said frame and extends in a substantially vertical plane across the width of said chamber, said baffle having an upper edge positioned closely adjacent the main cylinder at a point rearwardly from the nip between the doffer and main cylinder, the lower portion of said baffle being bent to slant downwardly and rearwardly whereby air currents being delivered beneath the carding elements by the rotation of the main cylinder and doffer are directed downwardly to the floor rather than creating a turbulence.

* * * * *